US010978830B2

(12) United States Patent
Hämmerling

(10) Patent No.: US 10,978,830 B2
(45) Date of Patent: Apr. 13, 2021

(54) LOCKABLE AND RELEASABLE PLUG

(71) Applicant: HARTING Electronics GmbH, Espelkamp (DE)

(72) Inventor: Sergej Hämmerling, Bohmte (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 16/760,163

(22) PCT Filed: Nov. 14, 2018

(86) PCT No.: PCT/DE2018/100931
§ 371 (c)(1),
(2) Date: Apr. 29, 2020

(87) PCT Pub. No.: WO2019/101269
PCT Pub. Date: May 31, 2019

(65) Prior Publication Data

US 2020/0343670 A1 Oct. 29, 2020

(30) Foreign Application Priority Data

Nov. 27, 2017 (DE) ..... 10 2017 127 991.1

(51) Int. Cl.
*H01R 13/627* (2006.01)
*H01R 13/639* (2006.01)

(52) U.S. Cl.
CPC ..... *H01R 13/639* (2013.01); *H01R 13/6271* (2013.01)

(58) Field of Classification Search
CPC ..... H01R 13/6271; H01R 13/6273
USPC ..... 439/352
See application file for complete search history.

(56) References Cited

U.S. PATENT DOCUMENTS 2,443,509 A * 6/1948 Lundy ..... H01R 24/20 439/738
3,933,406 A 1/1976 Cameron et al.
4,017,139 A * 4/1977 Nelson ..... F16L 37/133 439/352
4,919,627 A * 4/1990 Cable ..... H01R 39/64 439/180
5,004,431 A 4/1991 Previato et al.
(Continued)

FOREIGN PATENT DOCUMENTS

CN 201094141 7/2008
CN 102104211 A 6/2011
(Continued)

*Primary Examiner* — Neil Abrams
(74) *Attorney, Agent, or Firm* — Smartpat PLC

(57) ABSTRACT

A compact design for a push-pull latching system for a rectangular plug includes at least one locking and releasing element (11) which is held against a broad side of a plug housing in such a way that the locking and releasing element can be moved parallel to the broad side of the plug housing (1). The locking and releasing element (11) can be formed integrally with the plug housing (1) from an elastic plastic and can have a plurality of locking arms (111) having locking hooks (113). The movement necessary for releasing is then inversely proportional to the number of locking arms (111); the elasticity is also determined by the shape of the locking arms, in particular the width of the locking arms.

16 Claims, 3 Drawing Sheets

(56) References Cited

U.S. PATENT DOCUMENTS

| | | | | |
|---|---|---|---|---|
| 5,330,366 | A * | 7/1994 | Tsuji | H01R 13/6271 439/352 |
| 6,250,942 | B1 * | 6/2001 | Lemke | H01R 13/6272 439/352 |
| 7,040,911 | B1 * | 5/2006 | Ho | G02B 6/4292 439/352 |
| 7,484,988 | B2 * | 2/2009 | Ma | H01R 13/502 439/350 |
| 7,722,379 | B2 * | 5/2010 | Yang | H01R 13/6277 439/352 |
| 7,785,129 | B2 * | 8/2010 | Chen | H01R 13/5219 439/352 |
| 7,824,207 | B2 * | 11/2010 | Bergner | H01R 13/6271 439/352 |
| 7,892,004 | B2 * | 2/2011 | Hertzler | H01R 13/6277 439/312 |
| 8,690,591 | B2 * | 4/2014 | Charnesky | H01R 13/6397 439/153 |
| 8,944,838 | B2 * | 2/2015 | Mulfinger | G02B 6/3893 439/352 |
| 10,756,475 | B2 | 8/2020 | Tiemann et al. | |
| 2007/0232116 | A1 | 10/2007 | Bernat et al. | |
| 2010/0173513 | A1 | 7/2010 | Bergner et al. | |
| 2011/0136367 | A1 | 6/2011 | Schmettkamp et al. | |
| 2015/0016779 | A1 | 1/2015 | Schmidt et al. | |
| 2016/0248200 | A1 | 8/2016 | Jaeger et al. | |

FOREIGN PATENT DOCUMENTS

| | | | |
|---|---|---|---|
| DE | 19714459 | A1 | 10/1998 |
| DE | 102007031504 | A1 | 1/2009 |
| DE | 102012100615 | A1 | 7/2013 |
| DE | 102013222411 | A1 | 5/2015 |
| EP | 0366533 | A1 | 5/1990 |
| EP | 0704938 | A2 | 4/1996 |
| EP | 1841016 | A1 | 10/2007 |
| WO | 2016012006 | A1 | 1/2016 |

* cited by examiner

LOCKABLE AND RELEASABLE PLUG

TECHNICAL FIELD

The disclosure relates to a lockable and releasable plug connector which can be separated from a mating plug with only a little manual effort and is therefore very easy to use.

BACKGROUND

So-called "push-pull" plug connectors are well known in the prior art to the person skilled in the art. The operating concept of such plug connectors usually involves pulling a sleeve of the plug connector away from the mating plug in order to release the plug connector with the result that both the operation of the releasing apparatus and also the separation of the plug connector from the mating plug are performed in a single movement direction and thus with a single hand movement. The mating plug usually comprises a mounting housing and may be attached for example to a housing wall with the result that this procedure is generally performed with only one hand.

Document EP 1 841 016 B1 discloses a metal plug connector for use in a harsh and moist industrial environment. Said metal plug connector has a square-shaped plug connector housing, for example a zinc injection molded plug connector housing, which on one hand is encompassed by a corresponding releasing sleeve and in which on the other hand a plug insert is fixed. The plug connector housing is provided with a releasing sleeve and has a locking device that during the plug-in procedure forms a locking arrangement with a mating plug. As the releasing sleeve is pulled back, locking hooks of the locking device that are provided for the locking arrangement are pried "outwards" out of the latching recesses on the mating plug.

It is a disadvantage of this prior art that such mechanics increase considerably the construction size of the plug connector housing of a plug connector with the result that as a result of this mechanism known push-pull plug connectors have a cross-section that is too large for many applications.

During the course of the priority application relating to the current application, the German Patent and Trademark Office has researched the following prior art: DE 10 2013 222 411 A1 and DE 197 14 459 A1.

SUMMARY

The object of the disclosure is to propose a push-pull latching arrangement that requires as little installation space as possible and yet in the locked state ensures a sufficiently high holding force.

This object is achieved by the subject matter as claimed.

The lockable and releasable plug connector has the following:

- a plug connector housing having multiple sides each with a flat shape,
- a plug insert that is fixed or at least may be fixed in the plug connector housing,
- a releasing sleeve that encompasses the plug connector housing and is held against said plug connector housing in such a manner that said releasing sleeve may be displaced in the opposite direction to the plug-in direction,
- at least one locking and releasing element that is arranged between a first side of the plug connector housing and the releasing sleeve, wherein the locking and releasing element is held against the plug connector housing and is movable at least in regions parallel to this first side.

This is particularly advantageous since consequently a locking arrangement is possible that has a strong holding force and at the same time requires a small amount of installation space.

It is preferred that the plug connector housing may have a square cross-section or may have a rectangular shape or may preferably have four sides, in particular two broad sides and two narrow sides, of which in each case two identical sides lie opposite one another in a parallel manner. Accordingly, the releasing sleeve may also have a rectangular cross-section or may have a square shape.

In an advantageous manner, the locking and releasing element is formed at least in part from a spring-elastic material in order thereby to ensure its said movability. This is of particular advantage in relation to the cost-effective production, in particular if the locking and releasing element is attached in regions to the plug connector housing and in particular is even embodied as one piece therewith.

Multiple latching hooks may be arranged on the locking element, in particular formed as one thereon.

It is preferred that the locking element comprises multiple latching arms, wherein each latching arm has a first, namely a fixed, end and a second, namely a movable, end and wherein each latching arm is attached with its first (fixed) end to the plug connector housing and wherein the second (movable) end of the latching arm is movable parallel to the said side.

In one advantageous embodiment, the latching arms may be connected to one another between their first and second end via at least one cross brace and as a result they are able to move jointly. As a consequence, the locking element advantageously also requires only a single engaging or contacting mechanism that is used so as to cooperate with the releasing sleeve as said releasing sleeve is displaced in the opposite direction to the plug-in direction in order to move the complete releasing element, in other words in particular its latching arms, jointly in one direction.

In one alternative embodiment, multiple latching arms are held opposite one another in such a manner as to be able to move on the plug connector housing. This variant is particularly space-saving and therefore particularly advantageous for small constructions. Furthermore, irrespective thereof, this variant has the advantage that in particular the forces that occur during the releasing and/or locking procedures are distributed symmetrically over the plug connector housing and/or the releasing sleeve.

If the locking element has precisely two latching arms, these two latching arms may latch advantageously from opposite directions with a single common latching spigot. In a further embodiment, the locking element may have an even number of latching arms that preferably latch in pairs with multiple or also in each case with one common latching spigot of the mating plug.

One latching hook may be formed as one on each latching arm so as to latch with the respective latching spigot of the mating plug.

Advantageously, the latching hook may be formed as one in each case on the second end of the associated latching arm since the movability is the greatest at this site.

Each latching hook may have a latching surface that is oriented in the opposite direction to the plug-in direction so as to latch with the respective latching spigot of the mating plug. In the latched state, a common contact surface is thus formed between each latching hook and the associated latching spigot. The total of all contact surfaces produces a total contact surface that contributes to the holding force of the locking arrangement. The deflection that each latching arm must perform in order to contribute to the releasing procedure is however exclusively dependent upon the size of its individual contact surface that is naturally less than the total contact surface. This small deflection does however correspond to the deflection of the entire locking and releasing element as required for the releasing procedure. Advantageously, the necessary deflection, in particular deformation, of the locking and releasing element is inversely proportional to the number of its latching hooks.

This is particularly advantageous since this renders possible a locking apparatus that has a high holding force at which simultaneously an only slight movement, in particular deformation, is necessary for the locking and releasing procedure. The restoring spring force that occurs during this procedure may be regulated constructively by way of the shape of the latching arms, for example by way of its width, and also by way of the elasticity of the material.

In one preferred embodiment, at least one latching hook may have an upward-sliding incline or an upward-sliding rounded section so as to slide upward on the respective latching spigot of the mating plug. As an alternative or in addition thereto, the latching spigot may also have an upward-sliding incline or an upward-sliding rounded section. Advantageously, the latching hook tapers by way of the upward-sliding incline or upward-sliding rounded section toward the second end of the latching arm.

Furthermore, it is particularly advantageous if the latching arms are connected to one another in particular between their respective first and second end in a mechanical manner by way of example by means of a cross brace. Said latching arms are after all able to move jointly in this manner. Consequently, only one engaging or contacting mechanism is advantageously required for the entire locking element in order to ensure the said cooperation with the releasing sleeve. This cooperation is after all used so as to move, in particular to deform, the locking element in order in this manner to separate the latching surfaces of the latching hooks from the latching spigot(s) of the mating plug.

In one advantageous embodiment, the engaging or contacting mechanism may be in the form of a shaping on the locking element. In particular, the shaping may be a contacting incline that cooperates by way of example with a releasing spigot of the releasing sleeve. Naturally, it is conversely also possible for the releasing sleeve to have a contacting incline and for the locking element to have a releasing spigot.

In one advantageous embodiment, the latching arms may be formed as one at their first end on an attachment base of the plug connector housing. This has the advantage that the plug connector may be manufactured in a simple and consequently cost-effective manner.

In particular, the latching arms and the attachment base may be embodied together with the plug connector housing as one piece as a synthetic material part and may by way of example be manufactured in an injection molding procedure.

The plug connector housing may be embodied together with the locking element or the locking elements as a one-piece injection molded part. Advantageously, said plug connector housing is embodied from a synthetic material that on the one hand provides the plug connector housing with the necessary strength and on the other hand renders it possible for the latching arms to have sufficient spring elastic characteristics in the case of a corresponding geometry.

Such a material may be by way of example PBT ("polybutylene terephthalate") that is reinforced with glass fibers, in particular the so-called "PBT 33" may be used as a material for the plug connector housing with the locking element formed as one thereon, in other words polybutylene terephthalate with 33% glass fibers.

In one extremely advantageous embodiment, the plug connector has at least two locking elements that are arranged on two mutually parallel opposite-lying sides of the plug connector housing. Consequently, the plug connector may be locked on two mutually opposite-lying sides to the mating plug. Naturally, the releasing sleeve then also has appropriate unlatching means, by way of example releasing spigots, on the inner face of two side walls that lie opposite to one another in a parallel manner.

BRIEF DESCRIPTION OF THE DRAWINGS

One exemplary embodiment of the invention is illustrated in the drawings and is explained in detail below.

DETAILED DESCRIPTION

Figure 1A:
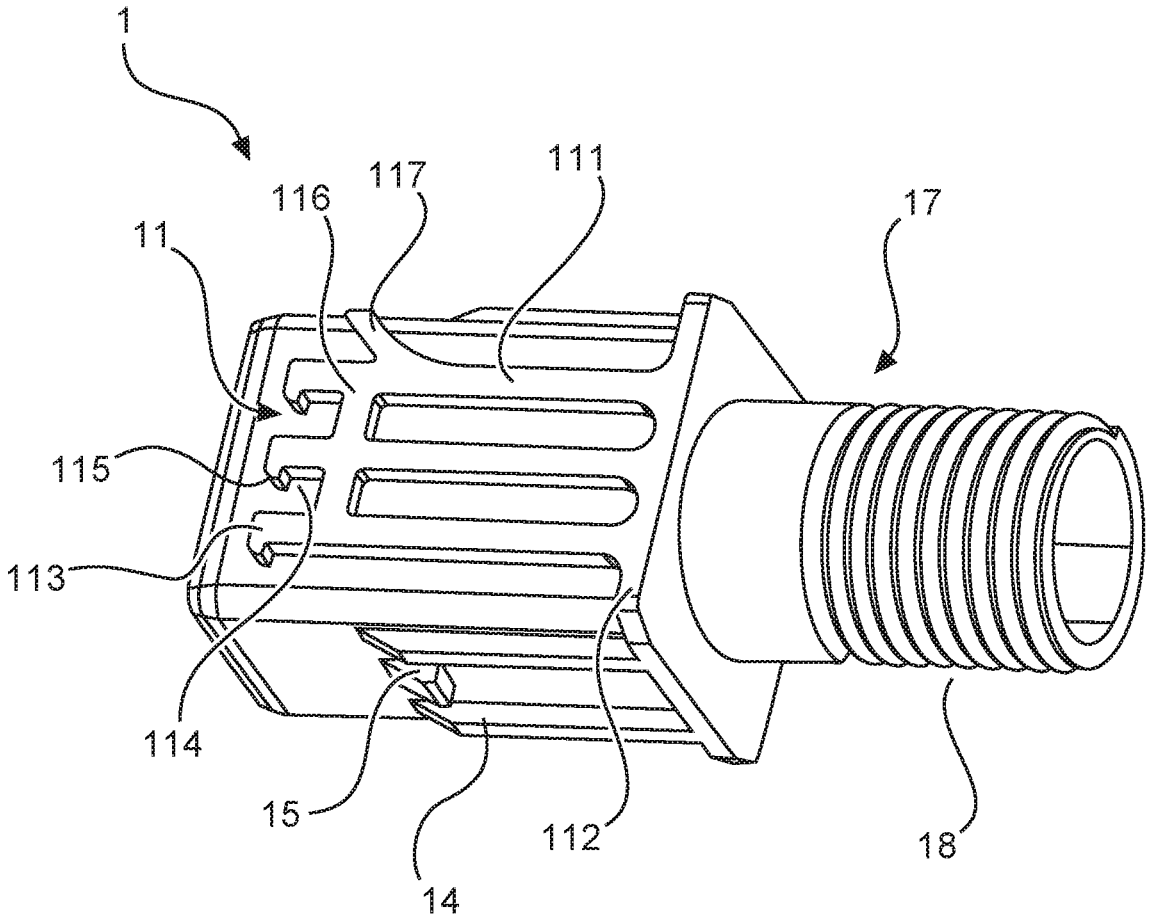
FIG. 1*a* illustrates a plug connector housing having a locking element.

The figures show in part simplified, schematic illustrations. To some extent, identical reference numerals are used for like but possibly not identical elements. Different views of like elements may be scaled differently.

FIG. 1 illustrates a plug connector housing 1 having a releasing element 11 in a first embodiment. On the cable connection side, a cable-inserting region 17 is formed as one on the plug connector housing 1 with a thread 18 of a cable screw connection 19, which is illustrated in FIG. 2*b* and described below.

Following on from this, the plug connector housing 1 has an attachment base 112. The plug connector housing 1 has a rectangular cross-section and has four sides that are arranged at right angles with respect to one another and/or parallel to one another, namely two broad sides and two narrow sides, which for reasons of overview are not provided with reference numerals. In this case, the two broad sides and the two narrow sides lie opposite and parallel to one another. In each case, a locking element 11 is arranged on the two mutually opposite-lying broad sides. However, in this view, only one of the two locking elements 11 is visible because the opposite-lying broad side is concealed by the plug connector housing 1.

The plug connector housing 1 has three latching arms 111 that are formed as one with a first end on the attachment base 112 and with their second end facing in the plug-in direction. The latching arms 111 are consequently attached on their first end to the plug connector housing 1 and by way of their elasticity are held thereon in such a manner as to be able to move parallel to the respective broad side. The latching arms have on a second, movable end latching hooks 113. The latching hooks 113 have a latching surface 114 in each case facing opposite the plug-in direction. In the plug-in direction, the latching hooks 113 have in each case an upward-sliding rounded section 115.

Furthermore, the latching arms 111 of the locking and releasing element are connected to one another by way of a common cross brace 116. As a consequence, they may be moved jointly parallel to the corresponding side wall.

The plug connector housing 1 has on its two mutually opposite-lying narrow sides guiding webs 14 so as to guide the releasing sleeve 2 that is described below. Furthermore, the plug connector housing 1 has on each narrow side a latching lug 15. Said latching lug prevents the releasing sleeve 2 once it has been latched onto said latching lug from becoming unintentionally separated from the plug connector housing 1.

An engaging mechanism 117 is formed as one on the locking element 11. Said engaging mechanism is provided for the purpose of cooperating with a releasing spigot 227 of the releasing sleeve 2 so as to perform the releasing procedure.

Figure 1B:
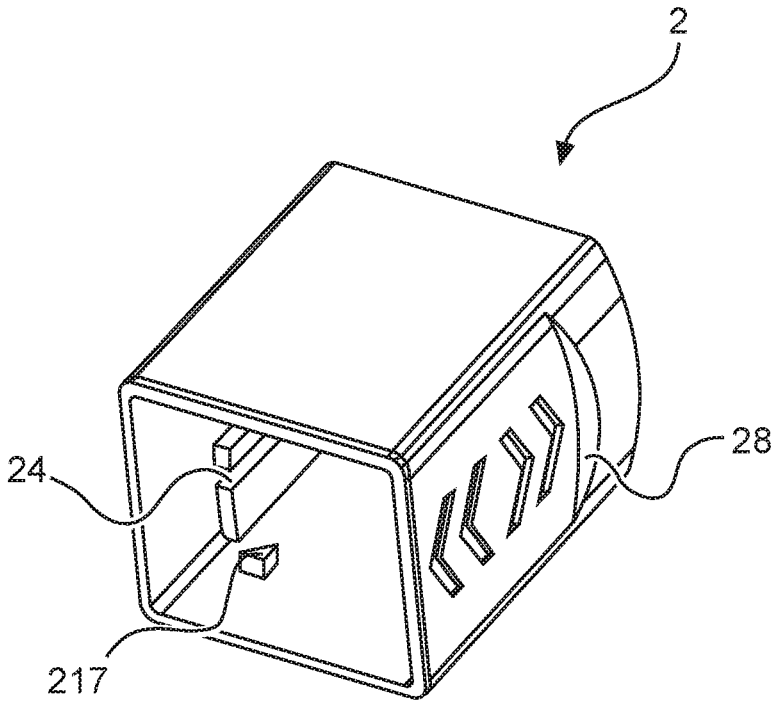
FIG. 1*b* illustrates a releasing sleeve.

FIG. 1*b* illustrates the said releasing sleeve 2. Said releasing sleeve has a rectangular cross-section and consequently four side walls, namely two narrow and two broad side walls, which are arranged at a right angle and/or parallel to one another, said respective side walls lying opposite to one another in a parallel manner. For the sake of overview, the side walls are not provided with reference numerals. The releasing sleeve 2 has on the two broad side walls in each case a releasing spigot 217 that has a releasing incline for cooperating with the engaging mechanism 117 of the plug connector housing 1. However, on account of the perspective, only the inner face of one of these two side walls and thus also only one releasing spigot 217 are visible in the drawing. Guiding grooves 24 are formed as one on the two narrow side walls, wherein on account of the perspective likewise only one inner face of these two side walls and thus only one guiding groove 24 is visible. The two guiding grooves 24 are suitable for cooperating with the guiding webs 14 of the plug connector housing 1 in order to hold the releasing sleeve 2 on the plug connector housing 1 in such a manner that said releasing sleeve may displace in the plug-in direction.

Furthermore, the releasing sleeve 2 has an actuation shaping 28 for manual actuation.

Figure 1C:
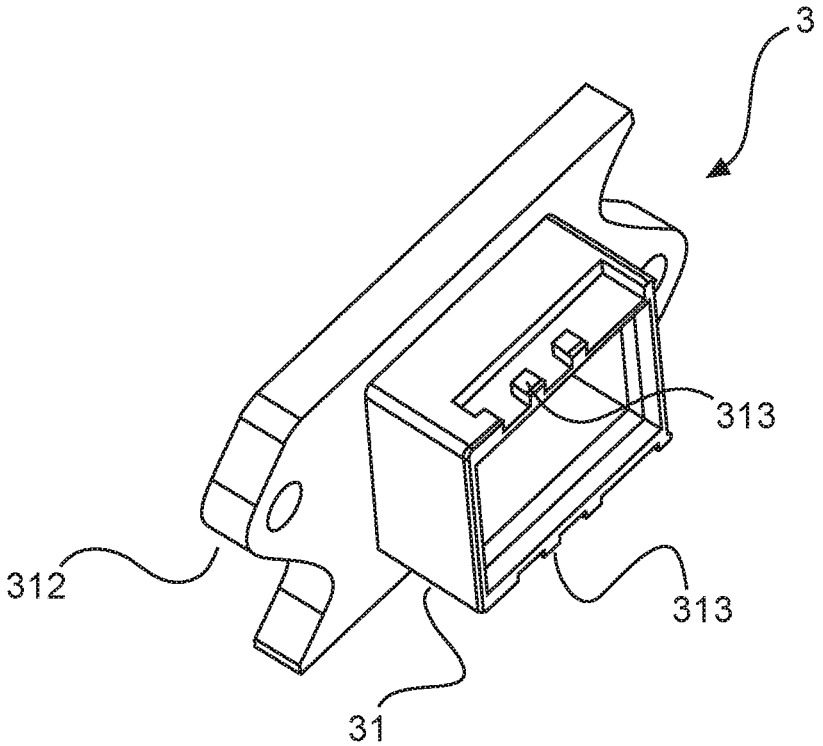
FIG. 1*c* illustrates a mating plug housing.

FIG. 1*c* illustrates a housing of a mating plug, in other words a mating plug housing 3. This mating plug housing 3 has a circumferential housing frame 31, the shape of which corresponds to that of the plug connector housing 1. At a right angle thereto, the mating plug housing 3 has an attachment flange 312 having screw holes, as a result of which the mating plug housing 3 is suitable by way of example for installation in a housing wall of an electrical device. The housing frame 31 has two long mutually opposite-lying frame sides and two short mutually opposite-lying frame sides that are arranged at a right angle to said long frame sides, for reasons of overview said short frame sides are not provided with reference numerals. The mating plug housing 3 has on the two long frame sides in each case two latching spigots 313.

Figure 2A:
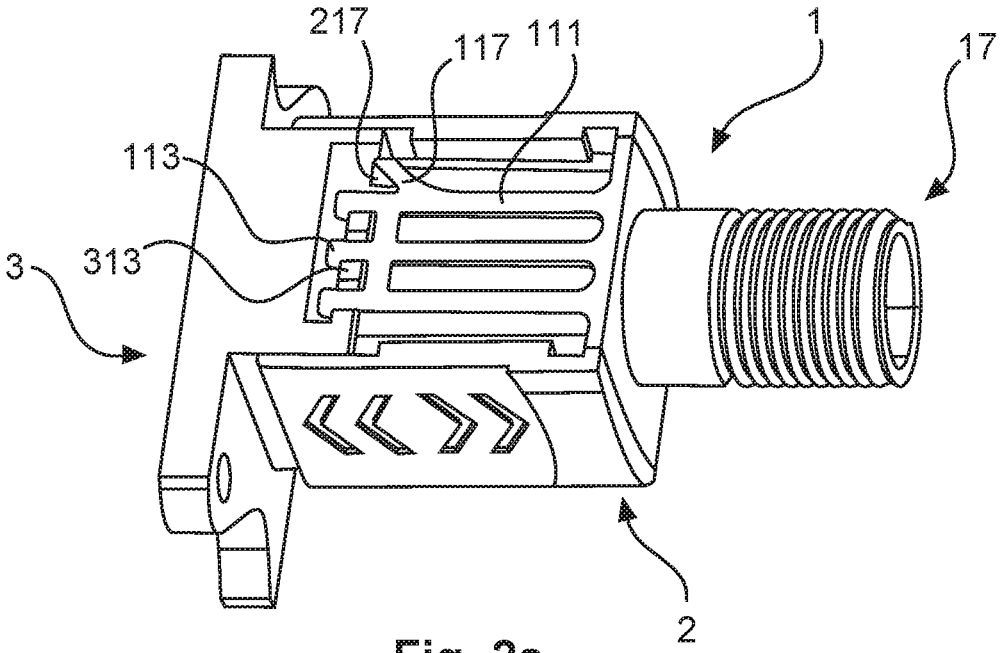
FIG. 2*a* illustrates a system comprising a plug connector and a mating connector in a first embodiment.
Figure 2B:
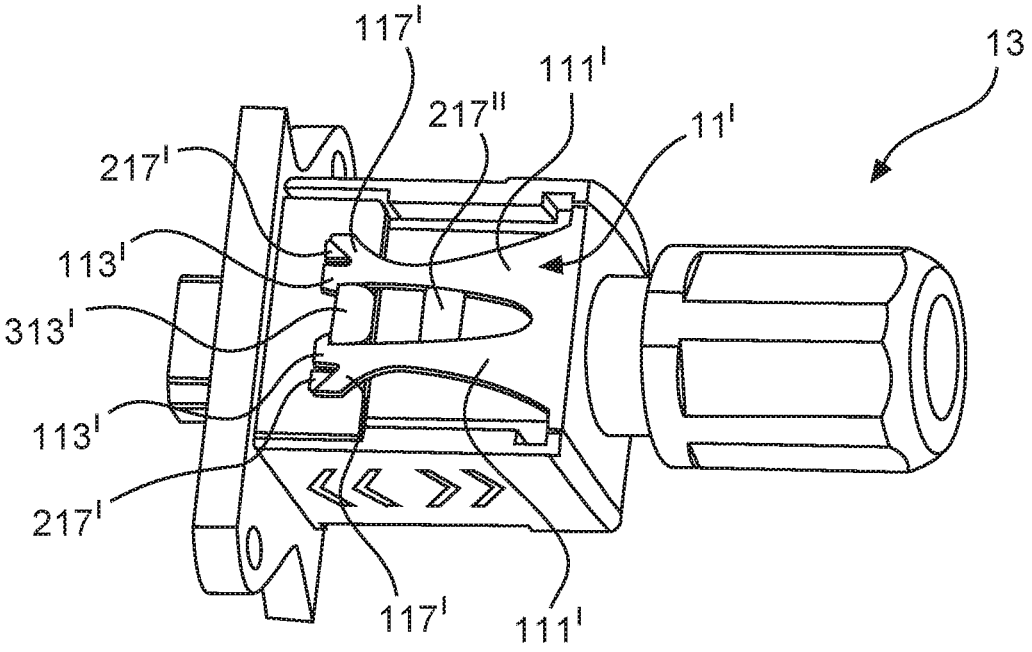
FIG. 2*b* illustrates a system comprising a plug connector and a mating connector in a second embodiment.

FIG. 2*a* illustrates a system comprising the plug connector housing 1 having the releasing sleeve 2, which is held on said plug connector housing in such a manner that said releasing sleeve may move in the plug-in direction, and the mating plug housing 3. In this case, so as to illustrate the mechanical cooperation of these components, 1, 2, 3, a broad side wall of the releasing sleeve 2 is blanked out, in other words only the releasing spigot 217 that is arranged on said side wall is visible in the drawing. This releasing spigot 217 is in mechanical contact with the engaging mechanism 117 of the locking and releasing element 11 via an incline.

It is easily apparent that by way of pulling the sleeve 2 toward the cable screw connection, in other words away from the mating plug housing, i.e. opposite to the plug-in direction, the releasing spigot 217 may act on the engaging mechanism in such a manner that the latching hooks 113 are separated from the latching spigots 313. Furthermore, it is clear that the deformation that is necessary for this occurs parallel to the broad side and is extremely small since it only corresponds to the size of the individual latching surface 114. In contrast, the entire latching surface of the locking and releasing element 11 is produced from the total of the associated individual latching surfaces 114, in this case it is therefore three times as large as each individual latching surface 114 since the locking and releasing element in this current example has three latching hooks 113. As a consequence, this construction is extremely compact. Furthermore, the necessary deformation is only very small which renders it possible for the plug connector housing 1 to be embodied as one piece with the locking and releasing element 11. The locking and releasing element 11 is arranged between a broad side of the plug connector housing 1 and a broad side wall of the releasing sleeve 2 and during the locking and releasing procedure moves parallel thereto. As already mentioned, the latching hooks 113 have upward-sliding rounded sections with which, as the plug connector housing 1 is plugged together with the mating plug housing 3, said upward-sliding rounded sections slide upward on the latching spigots 313 of said mating plug housing in order in the plugged-in state to latch therewith. In an alternative or supplementary embodiment, the latching spigots 313 may also have corresponding upward-sliding rounded sections in order to achieve the same effect.

This system has just such a mechanism on the opposite-lying side, not illustrated.

FIG. 2*b* illustrates a further embodiment of the disclosure. In this variant, the latching arms 111' of the locking and releasing elements 11' move in opposite directions to one another, in other words they move toward one another or away from one another, during the locking and releasing procedure. This variant is on the one hand particularly space-saving and therefore particularly advantageous for small constructions. Irrespective of this, this variant has furthermore the advantage that in particular the forces that occur during the releasing and/or locking procedures are distributed particularly uniformly over the plug connector housing 1 and/or the releasing sleeve 2.

As the mating plug housing 3 is plugged on, the two latching arms 111' are pushed apart from one another both by way of the upward-sliding rounded sections of their latching hooks 113' and also by way of the upward-sliding rounded sections of the common latching spigots 313' in order then to latch therewith in the plugged on state.

In order to perform the releasing procedure, the releasing sleeve 2 has on its broad side wall two releasing spigots 217' so as in each case to cooperate with an engaging mechanism 117' that is arranged on each of the two latching arms 111'. During the releasing procedure, the releasing sleeve 2 is pulled away from the mating plug housing 3—in other words in the opposite direction to the plug-in direction. As a consequence, the two latching arms 111' are pulled apart from their respective engaging mechanisms 117'. In so doing, their latching hooks 113' unlatch from the common latching spigot 313' of the mating plug housing 3. As a consequence, the plug connector housing 1 is released from the mating plug housing 3 and may be pulled off.

In the embodiment illustrated in the drawing, the releasing sleeve 2 has in addition a further releasing spigot 217"

that engages between two latching arms 111' and in addition pushes these two latching arms 111' apart from one another as the releasing sleeve 2 is pulled.

Consequently, during the releasing procedure the two latching arms 111' are both pulled apart from one another by the two releasing spigots 217' of the releasing sleeve 2 and they are also pushed apart by the further releasing spigot 217", although one of the two variants is sufficient for the functionality and—even though they are jointly illustrated in the drawing—they are understood by the person skilled in the art to be disclosed as being separate.

LIST OF REFERENCE NUMERALS

1 Plug connector housing
11, 11' Locking and releasing element
111, 111' Latching arms
112 Attachment base
113, 113' Latching hooks
114 Latching surface
115 Upward-sliding rounded section
116 Cross brace
117, 117' Engaging mechanism
13 Cable screw connection
14 Guiding webs
15 Latching lug
17 Cable-inserting region
18 Thread
2 Releasing sleeve
217, 217' Releasing spigot
217" Further releasing spigot
24 Guiding grooves
28 Actuation shaping
3 Mating plug housing
31 Housing frame
312 Attachment flange
313, 313' Latching spigot

The invention claimed is:

1. A lockable and releasable plug connector, comprising:
a plug connector housing (1) having multiple sides, each of the multiple sides having a flat shape;
a plug insert that is fixed in the plug connector housing (1);
a releasing sleeve (2) that encompasses the plug connector housing (1) and is held against the plug connector housing in such a manner that the releasing sleeve may be displaced in an opposite direction to a plug-in direction; and
a locking and releasing element (11, 11') that is arranged between a first of the multiple sides of the plug connector housing (1) and the releasing sleeve (2),
wherein the locking and releasing element (11, 11') is held on the plug connector housing (1) and is moveable parallel to the first of the multiple sides of the plug connector housing (1).

2. The lockable and releasable plug connector as claimed in claim 1,
wherein the locking and releasing element (11, 11') is made at least in part from a spring-elastic material in order thereby to ensure its movability.

3. The lockable and releasable plug connector as claimed in claim 1,
wherein the locking and releasing element (11, 11') has multiple latching arms (111, 111'),
wherein each of the multiple latching arms (111, 111') has a first end and a second end,
wherein each of the multiple latching arms (111, 111') is attached with its first end to the plug connector housing (1), and
wherein the second end of each of the multiple latching arms (111, 111') is movable parallel to the first of the multiple sides of the plug connector housing (1).

4. The lockable and releasable plug connector as claimed in claim 3,
wherein the multiple latching arms (111) are connected to one another between their respective first end and second end via a cross brace (116) and as a result are able to move jointly.

5. The lockable and releasable plug connector as claimed in claim 3,
wherein the multiple latching arms (111') are held opposite one another in such a manner that the multiple latching arms are able to move on the plug connector housing (1).

6. The lockable and releasable plug connector as claimed in claim 3,
wherein a latching hook (113, 113') is formed on each of the multiple latching arms (111, 111') so as to latch with a respective latching spigot (313, 313') of a mating plug housing (3).

7. The lockable and releasable plug connector as claimed in claim 6,
wherein the latching hook (113, 113') is formed on each second end of the multiple latching arms (111, 111').

8. The lockable and releasable plug connector as claimed in claim 3,
wherein each latching hook (113, 113') has a latching surface (115) that is oriented at a right angle to the respective latching arm (111, 111') and faces opposite to the plug-in direction.

9. The lockable and releasable plug connector as claimed in claim 6,
wherein at least one latching hook (113, 113') has a sliding incline or a sliding rounded section so as to slide on the respective latching spigot (313, 313') of the mating plug housing (3), and
wherein the at least one latching hook tapers toward its second end.

10. The lockable and releasable plug connector as claimed in claim 3,
wherein the latching arms (111, 111') are integrally formed on their first end on an attachment base of the plug connector housing (1).

11. The lockable and releasable plug connector as claimed in claim 3,
wherein the latching arms (111, 111') and an attachment basis are integrally formed with the plug connector housing (1) as one piece made of a synthetic material.

12. The lockable and releasable plug connector as claimed in claim 1,
wherein at least one engaging or contacting mechanism (117, 117') is arranged on the locking and releasing element (11, 11') and the at least one engaging or contacting element cooperates with the releasing sleeve (2) as the releasing sleeve is displaced in the direction opposite to the plug-in direction in order to move the locking and releasing element (11, 11').

13. The lockable and releasable plug connector as claimed in claim 1,
wherein the at least one engaging or contacting mechanism (117, 117') is a shaping on the locking and releasing element (11, 11'), and wherein the shaping has a contacting incline that cooperates with a releasing spigot (217, 217', 217") of the releasing sleeve (2).

14. The lockable and releasable plug connector as claimed in claim 1, wherein the plug connector has at least two locking elements (11, 11') that are arranged on two mutually parallel opposite-lying sides of the plug connector housing (1).

15. The lockable and releasable plug connector as claimed in claim 1, wherein the plug connector housing (1) is formed together with the locking and releasing element (11, 11') as a one-piece injection molded part.

16. The lockable and releasable plug connector as claimed in claim 15, wherein the plug connector housing (1) is made at least in part from PBT ("polybutylene terephthalate") that is reinforced with glass fibers.

* * * * *